US011830446B2

(12) United States Patent
Sun et al.

(10) Patent No.: US 11,830,446 B2
(45) Date of Patent: Nov. 28, 2023

(54) DISPLAY APPARATUS AND DISPLAY CONTROL METHOD

(71) Applicant: Hisense Visual Technology Co., Ltd., Shandong (CN)

(72) Inventors: Xuebin Sun, Shandong (CN); Jie Gao, Shandong (CN); Yang Yang, Shandong (CN)

(73) Assignee: HISENSE VISUAL TECHNOLOGY CO., LTD., Shandong (CN)

( * ) Notice: Subject to any disclaimer, the term of this patent is extended or adjusted under 35 U.S.C. 154(b) by 0 days.

(21) Appl. No.: 17/808,041

(22) Filed: Jun. 21, 2022

(65) Prior Publication Data

US 2022/0328015 A1 Oct. 13, 2022

Related U.S. Application Data

(63) Continuation of application No. PCT/CN2021/081883, filed on Mar. 19, 2021.

(30) Foreign Application Priority Data

May 26, 2020 (CN) ..... 202010455268.X
Jun. 1, 2020 (CN) ..... 202010483455.9
(Continued)

(51) Int. Cl.
*G09G 3/34* (2006.01)
*G09G 3/3291* (2016.01)

(52) U.S. Cl.
CPC ..... *G09G 3/3406* (2013.01); *G09G 3/3291* (2013.01); *G09G 2310/08* (2013.01);
(Continued)

(58) Field of Classification Search
CPC ..... G09G 3/3406; G09G 3/3291; G09G 2310/08; G09G 2320/0626;
(Continued)

(56) References Cited

U.S. PATENT DOCUMENTS

2007/0146300 A1 6/2007 Wu et al.
2008/0049006 A1 2/2008 Yi et al.
(Continued)

FOREIGN PATENT DOCUMENTS

CN 103390389 A 11/2013
CN 103606356 A 2/2014
CN 105825821 A 8/2016
CN 108335677 A 7/2018

OTHER PUBLICATIONS

English translation for CN 103390389, applicant TPV Technology LTD, published on Nov. 13, 2013. (Year: 2013).*
(Continued)

*Primary Examiner* — William Boddie
*Assistant Examiner* — Saifeldin E Elnafia
(74) *Attorney, Agent, or Firm* — Workman Nydegger

(57) ABSTRACT

The present application provides a display apparatus and a control method therefor. The display apparatus includes a mainboard, a power board, and a display panel, where the mainboard acquires a refresh rate of to-be-displayed video data, and adjusts a backlight control signal according to the refresh rate; and the power board drives a backlight source of the display panel according to the received backlight control signal.

10 Claims, 8 Drawing Sheets

(30) Foreign Application Priority Data

| | | |
|---|---|---|
| Jun. 1, 2020 | (CN) | 202010483467.1 |
| Jun. 1, 2020 | (CN) | 202010483707.8 |
| Jun. 3, 2020 | (CN) | 202010492953.X |
| Jun. 3, 2020 | (CN) | 202010493104.6 |

(52) U.S. Cl.
CPC ..... *G09G 2320/0613* (2013.01); *G09G 2320/0626* (2013.01); *G09G 2320/0673* (2013.01); *G09G 2330/02* (2013.01)

(58) Field of Classification Search
CPC ... G09G 2320/0613; G09G 2320/0673; G09G 2330/02
See application file for complete search history.

(56) References Cited

U.S. PATENT DOCUMENTS

| | | | | |
|---|---|---|---|---|
| 2018/0005599 | A1* | 1/2018 | Chen | G09G 5/10 |
| 2018/0090084 | A1* | 3/2018 | Zheng | G09G 3/3614 |

OTHER PUBLICATIONS

English translation for CN 108335677, applicant BOE Technology Group Co Ltd. Published on Jul. 27, 2018. (Year: 2018).*
International Search Report, CNIPA International Search Authority, dated Jun. 8, 2021, from PCT/CN2021/081883 filed Mar. 19, 2021.

* cited by examiner

DISPLAY APPARATUS AND DISPLAY CONTROL METHOD

CROSS REFERENCE TO RELATED APPLICATIONS

This application is a continuation application of PCT Application No. PCT/CN2021/081883, filed Mar. 19, 2021, which claims the priorities of the Chinese Patent Application No. 202010483455.9 filed on Jun. 1, 2020; Chinese Patent Application No. 202010483707.8 filed on Jun. 1, 2020; Chinese Patent Application No. 202010483467.1 filed on Jun. 1, 2020; Chinese Patent Application No. 202010455268.X filed on May 26, 2020; Chinese Patent Application No. 202010492953.X filed on Jun. 3, 2020; and the Chinese Patent Application No. 202010493104.6 filed on Jun. 3, 2020, all of them are incorporated herein by reference.

FIELD

The present application relates to display apparatuses, in particular to a display apparatus and a display control method.

BACKGROUND

With the development of science and technology, users have higher and higher requirements for a display effect of a display apparatus, such as fluency of display. Since a frame rate of a graphics processing unit (GPU) is not fixed in image rendering process, the display apparatus needs to set variable refresh rates (VRR) to match changes of the frame rate of the GPU, so as to make the content displayed by the display apparatus smoother. However, the refresh rate change of a display panel will change a brightness of the display panel, resulting in flickering in the display process, which affects user's experience.

SUMMARY

In some embodiments, the present application provides a display apparatus, including: a mainboard, a power board in connection with the mainboard, and a display panel in connection with the mainboard and the power board; the mainboard is configured to: acquire a refresh rate of to-be-displayed video data, and generate a backlight control signal according to the refresh rate of the to-be-displayed video data, and a first duty cycle of a first backlight control signal corresponding to a first refresh rate is different from a second duty cycle of a second backlight control signal corresponding to a second refresh rate, and the second refresh rate is different from the first refresh rate; and the power board is configured to: receive the backlight control signal and drive a backlight source of the display panel according to the backlight control signal.

In some embodiments, the mainboard includes a refresh rate monitor unit and a backlight adjusting unit; the refresh rate monitor unit is configured to acquire the refresh rate of the to-be-displayed video data; and the backlight adjusting unit is configured to generate the backlight control signal according to the refresh rate acquired by the refresh rate monitor unit.

In some embodiments, the backlight adjusting unit is further configured to: determine an adjustment coefficient according to the refresh rate of the to-be-displayed video data; obtain an adjusted duty cycle for the refresh rate by adjusting a duty cycle of a default backlight control signal according to the adjustment coefficient, and generate the backlight control signal corresponding to the refresh rate according to the adjusted duty cycle; and the default backlight control signal is preset for a default refresh rate.

In some embodiments, the backlight adjusting unit is further configured to:

calculate the adjustment coefficient K according to the refresh rate F and a formula $$K = A\frac{\overline{H}}{\frac{1}{F} - \frac{tr}{2}};$$

where $\overline{H}$ is an average light transmittance of the display panel corresponding to the default refresh rate, tr is response time of the display panel, and A is a preset coefficient.

In some embodiments, the backlight adjusting unit is further configured to: determine the adjustment coefficient according to the refresh rate of the to-be-displayed video data and a preset correspondence relationship between refresh rates and adjustment coefficients.

In some embodiments, the refresh rate monitor unit is configured to: determine the refresh rate according to a vertical synchronization signal corresponding to a video frame in the to-be-displayed video data.

In some embodiments, A is a value greater than 0 and less than 2.

In some embodiments, the backlight adjusting unit is further configured to determine the preset correspondence relationship between refresh rates and adjustment coefficients by playing a pure white image or a gray image, changing refresh rate a plurality of times, each time changing the refresh rate, adjusting the duty cycle of the backlight driving signal accordingly to make sure that display brightness of the display panel under the adjusted refresh rate is consistent with the display brightness under the default refresh rate.

In some embodiments, the backlight adjusting unit is further configured to: obtain the adjusted duty cycle for the refresh rate by multiplying a duty cycle of a default backlight control signal with the adjustment coefficient.

In some embodiments, the backlight control signal comprises PWM signal.

In some embodiments, the present application further provides a display control method, including: acquiring a refresh rate of to-be-displayed video data; and generating a backlight control signal according to the refresh rate of the to-be-displayed video data, where a first duty cycle of a first backlight control signal corresponding to a first refresh rate is different from a second duty cycle of a second backlight control signal corresponding to a second refresh rate, and the second refresh rate is different from the first refresh rate.

In some embodiments, the generating the backlight control signal according to the refresh rate of the to-be-displayed video data, includes: determining an adjustment coefficient according to the refresh rate of the to-be-displayed video data; obtaining an adjusted duty cycle for the refresh rate by adjusting a duty cycle of a default backlight control signal according to the adjustment coefficient, and generating the backlight control signal corresponding to the refresh rate according to the adjusted duty cycle, where the default backlight control signal is preset for a default refresh rate.

In some embodiments, the determining the adjustment coefficient according to the refresh rate of the to-be-displayed video data, includes:

calculating the adjustment coefficient K according to the refresh rate F and a formula $$K = A\frac{\overline{H}}{\frac{1}{F} - \frac{tr}{2}};$$

where $\overline{H}$ is an average light transmittance of the display panel corresponding to the default refresh rate, tr is response time of the display panel, and A is a preset coefficient.

In some embodiments, the generating the backlight control signal according to the refresh rate, includes: determining the adjustment coefficient according to the refresh rate of the to-be-displayed video data and a preset correspondence relationship between refresh rates and adjustment coefficients.

In some embodiments, the method further includes: determining the refresh rate according to a vertical synchronization signal corresponding to a video frame in the to-be-displayed video data.

In some embodiments, A is a value greater than 0 and less than 2.

In some embodiments, the determining the preset correspondence relationship between refresh rates and adjustment coefficients includes: playing a pure white image or a gray image; changing refresh rate a plurality of times, and adjusting the duty cycle of the backlight driving signal accordingly each time the refresh rate changed.

In some embodiments, the obtaining an adjusted duty cycle for the refresh rate by adjusting a duty cycle of a default backlight control signal, includes: obtaining the adjusted duty cycle for the refresh rate by multiplying a duty cycle of a default backlight control signal with the adjustment coefficient.

In some embodiments, the backlight control signal comprises PWM signal.

An embodiment of the present application further provides a display apparatus, including a mainboard, a panel driving board and a display panel; the panel driving board is connected between the mainboard and the display panel; and the mainboard is configured to: acquire a refresh rate of to-be-displayed video data, determine a adjustment coefficient according to the refresh rate, perform pixel processing on each frame video data corresponding to the refresh rate according to the adjustment coefficient, and output processed video data to the panel driving board, so as to enable the panel driving board to drive the display panel to display the video data.

In some embodiments, the mainboard includes: a refresh rate monitor unit, configured to acquire the refresh rate of the to-be-displayed video data; an adjustment coefficient determination unit, configured to determine the adjustment coefficient according to the refresh rate; an image processing unit, configured to perform pixel processing on the each frame video data corresponding to the refresh rate according to the adjustment coefficient; and a video output unit, configured to output the processed video data to the panel driving board, so as to enable the panel driving board to drive the display panel to display the video data.

In some embodiments, the adjustment coefficient determination unit is configured to:

calculate a highest light transmittance H corresponding to the refresh rate F according to the refresh rate F and a formula $$H = \frac{\overline{H}}{\frac{1}{F} - \frac{tr}{2}};$$

and take a ratio of the highest light transmittance of the display panel H and a highest light transmittance $H_0$ corresponding to a default refresh rate as the adjustment coefficient K;

where $\overline{H}$ is an average light transmittance corresponding to the default refresh rate, and tr is response time of the display panel.

In some embodiments, the adjustment coefficient determination unit is configured to: determine the adjustment coefficient according to the refresh rate and a preset correspondence relationship between refresh rates and adjustment coefficients.

In some embodiments, the image processing unit is configured to: multiply a pixel value of each pixel in the each frame video data corresponding to the refresh rate by the adjustment coefficient.

In some embodiments, the refresh rate monitor unit is configured to: determine the refresh rate according to a vertical synchronization signal corresponding to each frame video data in the to-be-displayed video data.

An embodiment of the present application further provides a display control method, including: acquiring a refresh rate corresponding to to-be-displayed video data; determining an adjustment coefficient according to the refresh rate; performing pixel processing on each frame video data corresponding to the refresh rate according to the adjustment coefficient; and outputting processed video data to a panel driving board, so as to enable the panel driving board to drive a display panel to display the video data.

In some embodiments, the determining the adjustment coefficient according to the refresh rate, includes:

calculating a highest light transmittance H corresponding to the refresh rate F according to the refresh rate F and a formula $$H = \frac{\overline{H}}{\frac{1}{F} - \frac{tr}{2}};$$

taking a ratio of the highest light transmittance of the display panel H and a highest light transmittance $H_0$ corresponding to a default refresh rate as the adjustment coefficient K;

where $\overline{H}$ is an average light transmittance corresponding to the default refresh rate, and tr is response time of the display panel.

In some embodiments, the determining the adjustment coefficient according to the refresh rate, includes: determining the adjustment coefficient according to the refresh rate and a preset correspondence relationship between refresh rates and adjustment coefficients.

In some embodiments, the performing pixel processing on the each frame video data corresponding to the refresh rate according to the adjustment coefficient, includes: multiplying a pixel value of each pixel in the each frame video data corresponding to the refresh rate by the adjustment coefficient.

An embodiment of the present application further provides a display apparatus, including: a mainboard, a panel driving board and a display panel; the panel driving board is connected between the mainboard and the display panel; the mainboard is configured to: acquire a refresh rate corresponding to to-be-displayed video data, determine a set of Gamma voltages according to the refresh rate, and send the set of Gamma voltages to the panel driving board; and the set of Gamma voltages is used for enabling the panel driving board to map received display signals to obtain panel driving signals for driving the display panel to display the video data.

In some embodiments, the mainboard includes: a refresh rate monitor unit, configured to: acquire a refresh rate corresponding to the to-be-displayed video data; and a Gamma voltage processing unit, configured to: determine the set of Gamma voltages according to the refresh rate, and send the set of Gamma voltages to the panel driving board.

In some embodiments, the Gamma voltage processing unit includes: a Gamma voltage coefficient determination subunit, configured to: calculate an adjustment coefficient of a Gamma voltage according to the refresh rate; and a Gamma voltage adjustment subunit, configured to: adjust a set of default Gamma voltages according to the adjustment coefficient to obtain the set of Gamma voltages, where the set of default Gamma voltages is preset for a default refresh rate.

In some embodiments, the Gamma voltage coefficient determination subunit is configured to:

calculate the adjustment coefficient K of the Gamma voltage according to the refresh rate F and a formula $$K = \frac{\overline{H}}{\frac{1}{F} - \frac{tr}{2}};$$

where $\overline{H}$ is an average light transmittance of the display panel corresponding to the default refresh rate, and tr is response time of the display panel.

In some embodiments, the Gamma voltage adjustment subunit is configured to: perform a difference operation between each default Gamma voltage and a reference voltage to obtain a difference value, where the reference voltage is a reference voltage of liquid crystal molecule deflection corresponding to the display apparatus; and multiply the difference value by the adjustment coefficient, and then perform a summation operation with the reference voltage to obtain the set of Gamma voltages.

In some embodiments, the Gamma voltage processing unit is configured to: determine the set of Gamma voltages according to the refresh rate and a preset correspondence relationship between refresh rates and adjustment coefficients.

In some embodiments, the Gamma voltage processing unit is configured to: determine an offset of the set of Gamma voltages according to the refresh rate and a preset correspondence relationship between the refresh rates and an offset of the Gamma voltages, and calculate the set of Gamma voltages according to the offset of the set of Gamma voltages and a set of default Gamma voltages, where the set of default Gamma voltages is preset for the default refresh rate.

In some embodiments, the panel driving board is configured to: generate a Gamma curve according to the set of Gamma voltages, map display signals according to the Gamma curve to obtain panel driving signals, and drive the display panel to display the video data according to the panel driving signals.

In some embodiments, the refresh rate corresponds to the set of Gamma voltages one by one.

An embodiment of the present application further provides a display control method, including: acquiring a refresh rate corresponding to to-be-displayed video data, determine a set of Gamma voltages according to the refresh rate, and send the set of Gamma voltages to a panel driving board, wherein the set of Gamma voltages is used for enabling the panel driving board to map received display signals to obtain panel driving signals for driving the display panel to display the video data.

According to the display apparatus and the display control method according to the embodiments of the present application, the refresh rate corresponding to the to-be-displayed video data is acquired in real time, display parameters are determined according to a dynamic state of the refresh rate, the display parameters include, but are not limited to at least one of the Gamma voltage, the adjustment coefficient, or the backlight brightness, and the display panel is controlled to display the video data according to the display parameters, so as to adjust the brightness stability of a picture displayed on the display panel, thereby avoiding flickering of the display picture.

DETAILED DESCRIPTION OF THE EMBODIMENTS

In order to make the objectives, embodiments and advantages of the present application clearer, the exemplary embodiments of the present application will be clearly and completely described below in combination with the accompanying drawings in the exemplary embodiments of the present application. Obviously, the described embodiments are only some but not all of the embodiments.

The display apparatus can set different refresh rates through a variable refresh rate (VRR) technology, such as Gsync, Freesync, etc., to adapt to frame rate changes of a graphics processing unit (GPU), so that content displayed on a panel is smoother. The display apparatus may be any device with a display panel, such as a television, a computer, an intelligent display panel, an all-in-one machine, a mobile phone and a notebook computer. Taking the display panel being a liquid crystal display panel as an example, the change of the refresh rate of the display apparatus will cause a ratio change of turnover time of liquid crystal molecules in a display cycle, resulting in an average light transmittance change of the display panel per unit time, and then a change of display brightness.

Figure 1:
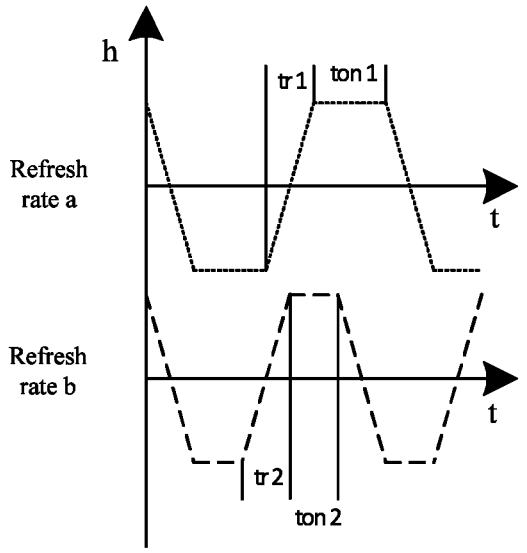
FIG. 1 is a schematic diagram of a display cycle of a liquid crystal display panel according to an embodiment of the present application.

FIG. 1 is a schematic diagram of a display cycle of a liquid crystal display panel according to an embodiment of the present application. A display process of the liquid crystal display panel is divided into two parts, one is a response process and the other is a display process. As shown in FIG. 1, a horizontal axis is a time t axis, and a vertical axis is a light transmittance h axis, where tr1 or tr2 is response time corresponding to the response process, namely time required for liquid crystal molecules to rotate to a specific state; and ton is display time corresponding to the display process, namely normal display time after the liquid crystal molecules rotate to the specific state. FIG. 1 shows changes of the light transmittance of the liquid crystal display panel under two refresh rates, a refresh rate a is smaller than a refresh rate b, and therefore, the display cycle of the liquid crystal display panel under the refresh rate b is shorter. Under the same liquid crystal drive, the response time of the liquid crystal molecules is basically the same, that is, tr1 is equal to tr2. Therefore, the display cycle under the refresh rate b is shorter than the display cycle under the refresh rate a, which will shorten the display time ton, that is, ton2 is smaller than ton1.

It can be seen that the higher the refresh rate, the darker the brightness of the liquid crystal display panel, and the lower the refresh rate, the brighter the brightness of the liquid crystal display panel. With the changing of the refresh rate, flickering of a display picture of the liquid crystal display panel will occur. The embodiment of the present application can be applied to the above scenario, different display parameters are determined according to different refresh rates, and a display apparatus displays according to different display parameters, so that the display panel keeps the stability of the display brightness, and flickering of the display picture is avoided. The display parameters include but are not limited to at least one of a Gamma voltage, an adjustment coefficient and backlight brightness.

In order to enable the display panel to keep the stability of the display brightness in the display process, in the embodiment of the present application, the refresh rate of to-be-displayed video data is acquired in real time, the display parameters are determined according to a dynamic state of the refresh rate, and the display panel is controlled to display the video data according to the display parameters, so as to adjust the brightness stability of the image displayed on the display panel.

In some embodiments, the present application is directed to dynamically adjusting the Gamma voltage and changing an average light transmittance of the liquid crystal molecules, so as to realize a variable refresh rate.

Figure 2:
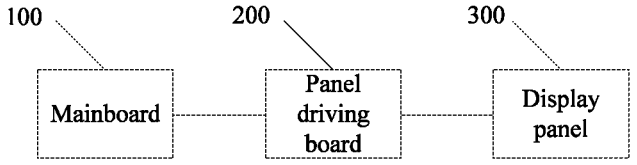
FIG. 2 is a schematic structural diagram of a display apparatus according to an embodiment of the present application.

FIG. 2 is a schematic structural diagram of a display apparatus according to an embodiment of the present application. As shown in FIG. 2, the display apparatus 001 includes a mainboard 100, a panel driving board 200 and a display panel 300. The panel driving board 200 is connected between the mainboard 100 and the display panel 300. The mainboard 100 is configured to acquire a refresh rate of to-be-displayed video data, determine a set of Gamma voltages according to the refresh rate, and then send the set of Gamma voltages to the panel driving board 200. The set of Gamma voltages are used for enabling the panel driving board 200 to map received display signals, so as to obtain panel driving signals for driving the display panel 300 to display the video data. The panel driving board 200 generates the panel driving signals according to the set of Gamma voltages and the received display signals, and sends the panel driving signals to the display panel 300, so as to enable the display panel 300 to display the video data according to the panel driving signals.

Figure 3:
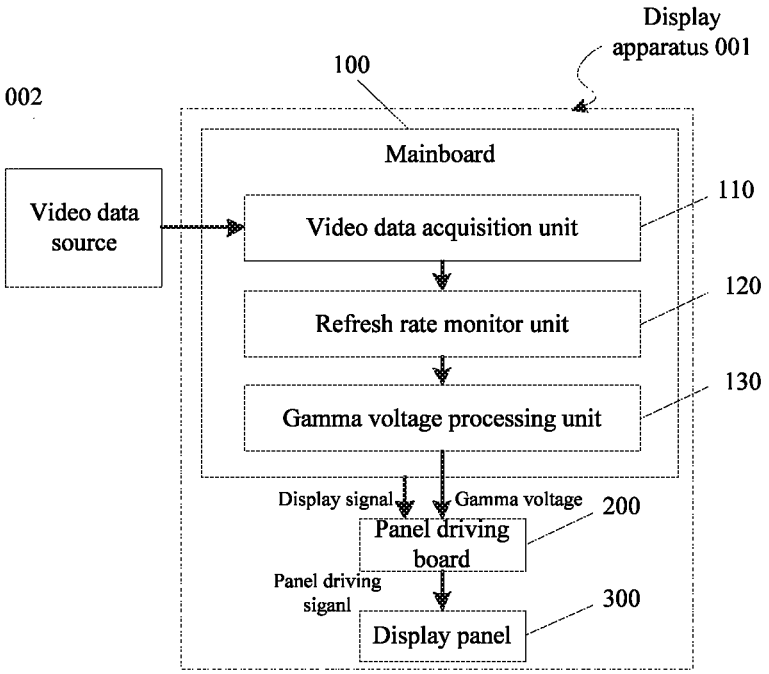
FIG. 3 is a schematic structural diagram of a display apparatus according to an embodiment of the present application.

FIG. 3 is a schematic structural diagram of a display apparatus according to an embodiment of the present application. As shown in FIG. 3, the mainboard 100 at least includes: a refresh rate monitor unit 120 and a Gamma voltage processing unit 130. As shown in FIG. 3, in some embodiments, the refresh rate monitor unit 120 acquires vertical synchronization signals of the to-be-displayed video data, each frame of the video data corresponds to one vertical synchronization signal, and the vertical synchronization signal carries the refresh rate corresponding to the video frame. In some embodiments, the vertical synchronization signals are sent before the corresponding video frames.

In some embodiments, the mainboard 100 further includes a video data acquisition unit 110. The video data acquisition unit 110 is configured to acquire the to-be-displayed video data from a video data source 002, and perform the video data decoding. In some embodiments, the refresh rate monitor unit 120 acquires the vertical synchronization signals of the to-be-displayed video data from the video data acquisition unit 110. The video data source 002 may be a server, a storage medium, an image capture device, a high definition multimedia interface (HDMI) channel and the like.

In some embodiments, the video data source 002 first sends the video data to the GPU (not shown in the figure), so that the GPU performs rendering processing on the video data and generates the vertical synchronization signals at the same time, and the refresh rate monitor unit 120 acquires the vertical synchronization signals and the rendered video data from the GPU. In some embodiments, the GPU may be arranged on a graphics card or a mainboard, and in some embodiments, the graphics card may be independent of the mainboard, or integrated on the mainboard. The refresh rate monitor unit 120 sends the acquired refresh rate to the Gamma voltage processing unit 130, the Gamma voltage processing unit 130 determines a set of Gamma voltages according to the refresh rate, and sends the set of Gamma voltages to the panel driving board 200. A set of Gamma voltages includes a plurality of Gamma voltages required for the panel driving board 200 to map the display signals, and in some embodiments, the quantity of the Gamma voltages may be 12.

Figure 4:
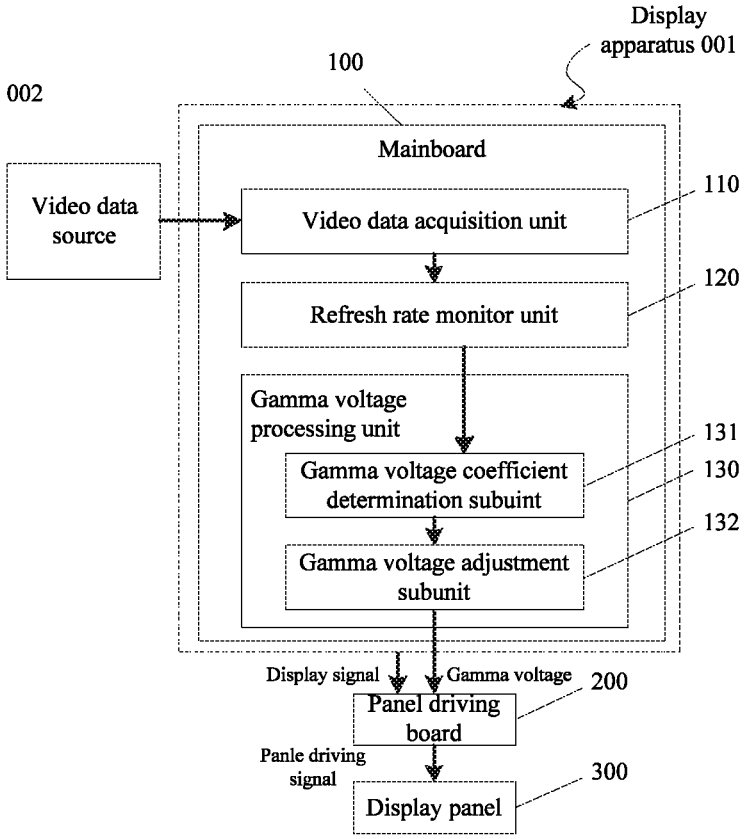
FIG. 4 is a schematic structural diagram of a display apparatus according to an embodiment of the present application.

FIG. 4 is a schematic structural diagram of a display apparatus according to an embodiment of the present application. As shown in FIG. 4, in some embodiments, the Gamma voltage processing unit 130 includes: a Gamma voltage coefficient determination subunit 131 and a Gamma voltage adjustment subunit 132.

The Gamma voltage coefficient determination subunit 131 is configured to calculate an adjustment coefficient of a Gamma voltage according to the refresh rate; the Gamma voltage adjustment subunit 132 is configured to adjust a set of default Gamma voltages according to the adjustment coefficient to obtain the set of Gamma voltages; and the set of default Gamma voltages is a set of Gamma voltages predetermined for a default refresh rate.

In some embodiments, the video data acquisition unit 110, the refresh rate monitor unit 120 and the Gamma voltage processing unit 130 may be arranged in a system-on-a-chip (SOC) of the mainboard. The panel driving board 200 generates a Gamma curve according to the plurality of received Gamma voltages, maps the received display signals according to the Gamma curve to obtain the panel driving signals, and then drives the display panel 300 to display the video data according to the panel driving signals. The display signals are signals conforming to any image transmission protocol, such as a VByOne signal, a low-voltage differential signaling (LVDS) signal, etc.

Figure 5:
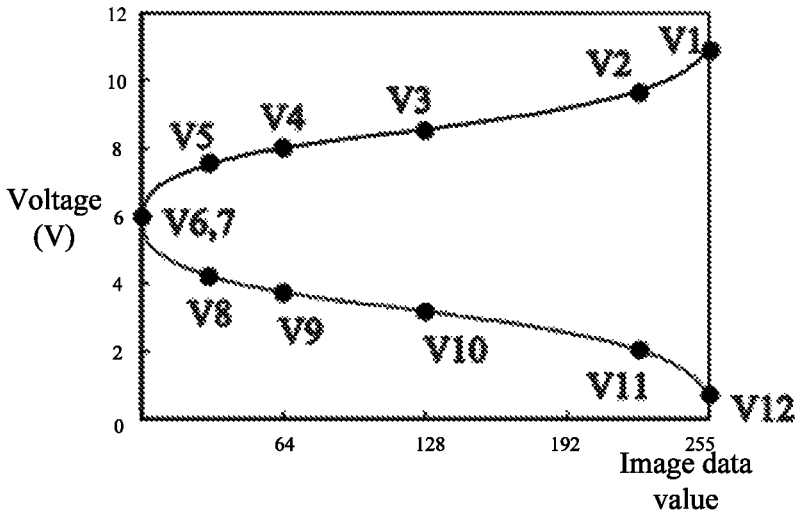
FIG. 5 is a schematic diagram of a Gamma curve according to an embodiment of the present application.

FIG. 5 is a schematic diagram of a Gamma curve according to an embodiment of the present application. The Gamma voltage processing unit 130 sends the 12 Gamma voltages V1-V12 to the panel driving board 200, the panel driving board 200 generates the Gamma curve as shown in FIG. 5 according to the Gamma voltages V1-V12, and the Gamma curve is located in a two-dimensional coordinate system in which the horizontal axis is an image data value and the vertical axis is a voltage value. It should be understood that V6 is equal to V7 and is equal to a reference voltage Vcom for liquid crystal molecule deflection. Further, the panel driving board 200 maps voltage values of the received display signals in the Gamma curve generated to obtain an image data value corresponding to each display signal (the image data value is generally between 0 and 255), and generates the panel driving signals according to the image data values, so as to drive the display panel 300 to display the corresponding video data.

It should be understood that different Gamma curves will enable the display signals to map different image data values. When the refresh rate increases, the Gamma voltage processing unit 130 should output a larger Gamma voltage, the Gamma curve generated according to the increased Gamma voltage maps a lower image data value, and therefore, the brightness is higher. Conversely, the Gamma voltage processing unit 130 outputs a smaller Gamma voltage, and thus the display brightness of the display panel can be reduced. Generally, different refresh rates correspond to different sets of Gamma voltages, that is, the refresh rates are in one-to-one correspondence to the sets of Gamma voltages; alternatively, a plurality of refresh rates may correspond to one set of Gamma voltages, such as a plurality of refresh rates adjacent in numerical values.

In some embodiments, the display apparatus 001 may further include a Gamma integrated circuit chip (IC) (not shown in the figure), the Gamma IC may be arranged on the mainboard or the panel driving board, which is not required in the present application. In some embodiments, the Gamma IC and the Gamma voltage processing unit may be connected through an inter integrated-circuit ($I^2C$) port, the Gamma IC and the panel driving board may be connected through a plurality of input and output I/O ports, and the Gamma IC receives the voltage values from that set of Gamma voltages sent from the Gamma voltage processing unit through an $I^2C$ bus, converts the value of each Gamma voltage into a voltage, and sends the voltage to the panel driving board 200 through the plurality of I/O ports.

In the display apparatus 001 according to embodiments of the present application, the refresh rate corresponding to the video data to be displayed is acquired in real time by the refresh rate monitor unit 120, the magnitudes of the set of Gamma voltages are adjusted in real time by the Gamma voltage processing unit 130 according to the refresh rate, and then the Gamma curve is generated by the panel driving board 200 according to the set of Gamma voltages, so that a mapping result of the display signals in the Gamma curve is changed, the adjustment of the display brightness is realized, and the flickering issue of the display image is avoided.

An embodiment of the present application further provides a display control method, which can be applied to the display apparatus 001 according to any one of the above embodiments.

Figure 6:
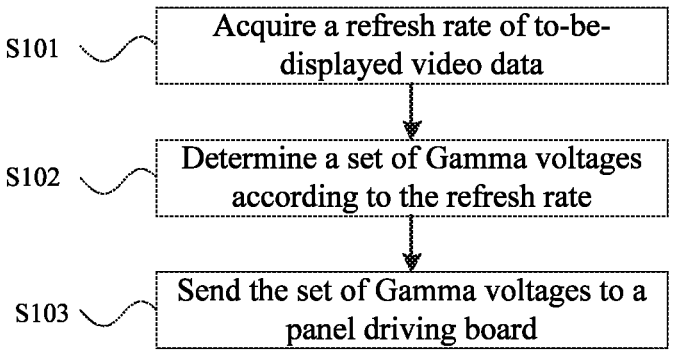
FIG. 6 is a schematic flow chart of a display control method according to an embodiment of the present application.

FIG. 6 is a schematic flow chart of a display control method according to an embodiment of the present application. As shown in FIG. 6, the method includes: S101, a refresh rate of to-be-displayed video data is acquired. S102, a set of gamma voltages is determined according to the refresh rate. In this step, in order to adapt changes of a Gamma voltage with changes of the refresh rate, a Gamma voltage processing unit 130 determines the set of Gamma voltages in real time according to the refresh rate, and several implementations are described below.

In some embodiments, an adjustment coefficient of a Gamma voltage is calculated according to the refresh rate, and a set of default Gamma voltages is adjusted according to the adjustment coefficient to obtain a set of Gamma voltages. A set of default Gamma voltages is a set of Gamma voltages predetermined for a default refresh rate, and generally, the default refresh rate is a fixed refresh rate of the display apparatus without a VRR.

Figure 7:
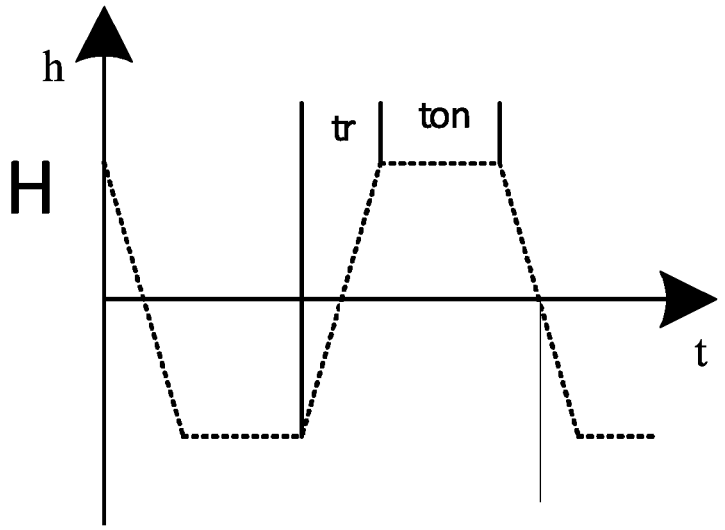
FIG. 7 is a schematic diagram of a relationship between a display cycle and a light transmittance according to an embodiment of the present application.

FIG. 7 is a schematic diagram of a relationship between a display cycle and a light transmittance according to an embodiment of the present application. In order to control the display brightness of the display apparatus to be stable all the time, an average light transmittance of a display panel needs to be controlled to be stable, that is, under any refresh rate, it is ensured that the average light transmittance of the display panel is kept substantially unchanged. Based on the above reasons and as shown in FIG. 7, it can be seen that a relationship between the refresh rate F and display time ton may be expressed by a formula $ton=1/F-tr$ (1), where tr is response time of the display panel; and the average light transmittance under the default refresh rate may be expressed by a formula $\overline{H}=ton*H+tr*H/2$ (2), where H is a highest light transmittance under the refresh rate obtained in real time, * denotes multiplication operation, / denotes division operation.

According to formula (1) and formula (2), it can be known that $$H = \frac{\overline{H}}{\frac{1}{F} - \frac{tr}{2}}.$$

Since H has a positive correlation with the Gamma voltages, it can be known that the adjustment coefficient $$K = \frac{\overline{H}}{\frac{1}{F} - \frac{tr}{2}}.$$

In some embodiments, a difference operation is performed between each default Gamma voltage and a reference voltage Vcom to obtain a difference value, and then after the different value is multiplied by the adjustment coefficient, a summing operation is performed with the reference voltage Vcom, that is, the default Gamma voltage is adjusted up or adjusted down to obtain a final set of Gamma voltages.

Figure 8:
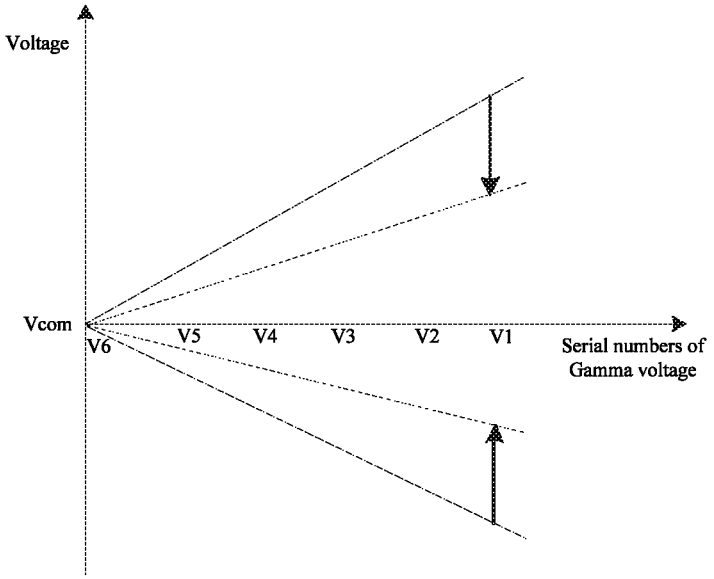
FIG. 8 is a schematic diagram of Gamma voltage decrease according to an embodiment of the present application.

FIG. 8 is a schematic diagram of Gamma voltage decrease according to an embodiment of the present application. When the adjustment coefficient K is smaller than 1, the set of default Gamma voltage is reduced, for example, from a solid line to a position shown by a dotted line as shown in FIG. 8.

In some embodiments, the set of Gamma voltages is determined according to the refresh rate and a preset correspondence relationship between the refresh rate and the Gamma voltages.

In this implementation, the Gamma voltages under different refresh rates need to be acquired in advance through test data. In some embodiments, when displayed content remains unchanged, for example, when displaying pure white content, the refresh rate is continuously changed, and each time the refresh rate is changed, the set of default Gamma voltages is adjusted, so that the display brightness of the display panel under the refresh rate is consistent with the display brightness under the default refresh rate; and then the adjusted set of Gamma voltages is used as the Gamma voltages corresponding to the refresh rate, and the Gamma voltage corresponding to each different refresh rate is determined accordingly. In this embodiment, the Gamma voltage corresponding to each refresh rate is determined in advance, a calculation flow is simplified, and the processing efficiency of the Gamma voltage processing unit 130 is improved.

In some embodiments, an offset of the set of Gamma voltages is determined according to the refresh rate and a preset correspondence relationship between the refresh rate and an offset of the Gamma voltage; and the set of Gamma voltages is calculated according to the offset of the set of Gamma voltages and a set of default Gamma voltages. The offsets of the Gamma voltages under different refresh rates need to be acquired in advance through test data. In some embodiments, when the displayed content remains unchanged, for example, when displaying pure white content, the refresh rate is continuously changed, and each time the refresh rate is changed, the set of default Gamma voltages is adjusted, so that the display brightness of the display panel under the refreshed rate is consistent with the display brightness under the default refresh rate; and then offsets of the adjusted set of default Gamma voltages are used as offsets of the set of Gamma voltages corresponding to the refresh rate, and the offsets of the set of Gamma voltage corresponding to each different refresh rate are determined accordingly. It should be understood that the offsets of the set of Gamma voltages may be the same or different. If the offsets of the set of Gamma voltages are the same, data size of the correspondence relationship between the refresh rates and the offsets of the Gamma voltages is small, and a storage space is saved.

In some embodiments, the final set of Gamma voltages may be calculated according to the offsets of the set of Gamma voltages and the set of default Gamma voltages.

S103, the set of Gamma voltages is sent to a panel driving board.

In this step, the set of Gamma voltages is sent to the panel driving board, so as to cause the panel driving board to drive the display panel to display the video data according to the set of Gamma voltages and display signals received. The refresh rate corresponding to the video data to be display is acquired in real time, the magnitude of the set of Gamma voltages is adjusted in real time according to the refresh rate, and then the Gamma curve is generated according to the set of Gamma voltages, so that the mapping result of the display signals in the Gamma curve is changed, the adjustment of the display brightness is realized, and the flickering issue of the display image is avoided. In some embodiments, the present application proposes to dynamically adjust pixel values of the video data and increase or decrease the magnitudes of the pixel values, so that a variable refresh rate is realized.

Figure 9:
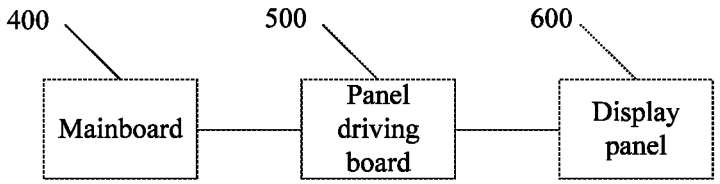
FIG. 9 is a schematic structural diagram of a display apparatus according to an embodiment of the present application.

FIG. 9 is a schematic structural diagram of a display apparatus according to an embodiment of the present application. As shown in FIG. 9, the display apparatus 003 includes a mainboard 400, a panel driving board 500 and a display panel 600. The panel driving board 500 is connected between the mainboard 400 and the display panel 600. The mainboard 400 is configured to acquire a refresh rate of to-be-displayed video data, determine a adjustment coefficient according to the refresh rate, perform pixel processing on each frame of the video data corresponding to the refresh rate according to the adjustment coefficient, and output the processed video data to the panel driving board. The panel driving board 500 drives the display panel 600 to display the processed video data.

Figure 10:
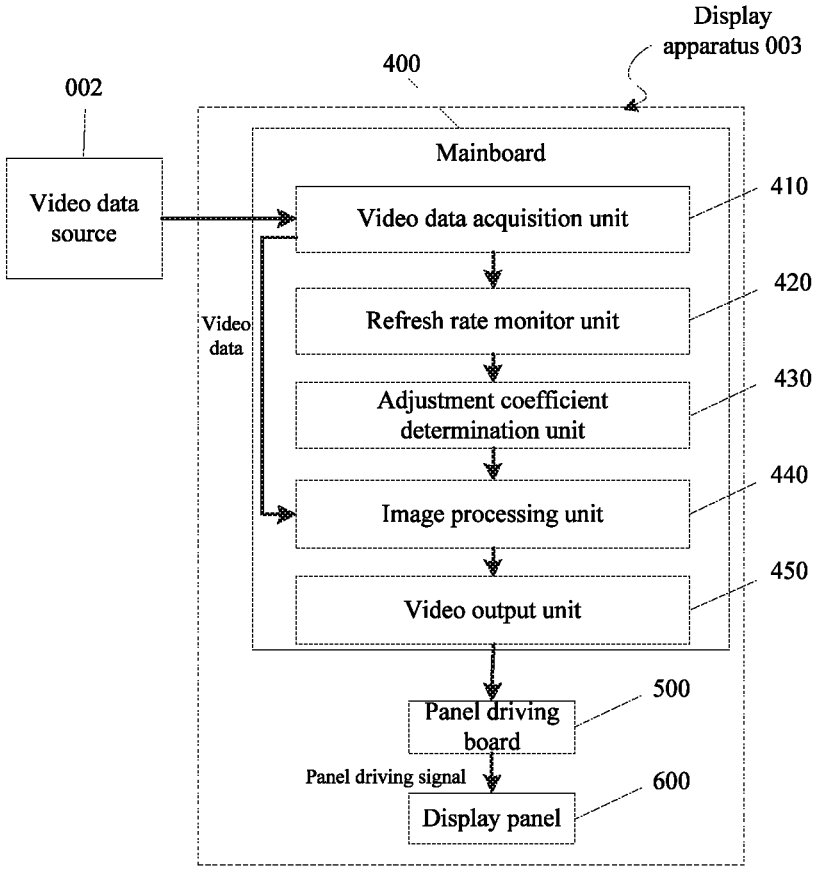
FIG. 10 is a schematic structural diagram of a display apparatus according to an embodiment of the present application.

FIG. 10 is a schematic structural diagram of a display apparatus according to an embodiment of the present application. As shown in FIG. 10, in some embodiments, the mainboard 400 at least includes: a refresh rate monitor unit 420, an adjustment coefficient determination unit 430, an image processing unit 440 and a video output unit 450. In some embodiments, the mainboard 400 further includes a video data acquisition unit 410. The video data acquisition unit 410 is configured to acquire the to-be-displayed video data from a video data source 002, and perform decoding processing on the video data. In the embodiments of the present application, the video data source 002, the video data acquisition unit 410 and the refresh rate monitor unit 420 are consistent with the corresponding contents in the above embodiments, which will not be repeated here.

The refresh rate monitor unit 420 sends the acquired refresh rate to the adjustment coefficient determination unit 430, and the adjustment coefficient determination unit 430 determines the adjustment coefficient according to the refresh rate in real time, and sends the adjustment coefficient matched with the refresh rate to the image processing unit 440.

The image processing unit 440 receives the adjustment coefficient sent from the adjustment coefficient determination unit 430, and acquires the video data from the video data acquisition unit 410. The image processing unit 440 performs pixel processing on each frame of the video data corresponding to the acquired refresh rate according to the adjustment coefficient. It should be understood that when the refresh rate is low, the display brightness is high, and the pixel value needs to be increase, so as to reduce the display brightness; and vice versa, when the refresh rate is high, the display brightness is low, and the pixel value needs to be decreased, so as to improve the display brightness.

The video output unit 450 outputs the video data after pixel processing to the panel driving board 500, so as to cause the panel driving board 500 to generate a drive signal, and drive the display panel to display the video data through the drive signal. In some embodiments, the video data acquisition unit 410, the refresh rate monitor unit 420, the adjustment coefficient determination unit 430, the image processing unit 440 and the video output unit 450 may all be arranged in an SOC of the mainboard.

In the display apparatus 003 according to the embodiment of the present application, the refresh rate corresponding to the to-be-displayed video data is acquired in real time by the refresh rate monitor unit 420, the adjustment coefficient is determined by the adjustment coefficient determination unit 430 according to the refresh rate, then pixel processing is performed on the to-be-displayed video data by the image processing unit 440 according to the adjustment coefficient, the magnitude of the pixel value is increased or decreased, the adjustment of the display brightness is realized, and thus the display brightness of the video data finally displayed on the display panel is stable.

An embodiment of the present application further provides a display control method, which can be applied to the display apparatus 003 according to any one of the above embodiments.

Figure 11:
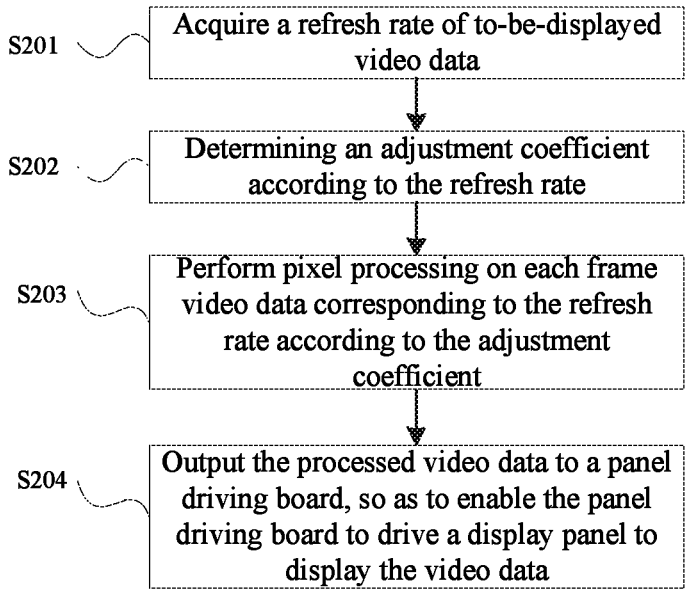
FIG. 11 is a schematic flow chart of a display control method according to an embodiment of the present application.

FIG. 11 is a schematic flow chart of a display control method according to an embodiment of the present application. As shown in FIG. 11, the method includes: S201, a refresh rate corresponding to to-be-displayed video data is acquired. S202, an adjustment coefficient is determined according to the refresh rate. In the embodiment of the present application, different adjustment coefficients are determined for different refresh rates, so as to perform pixel processing on pixels of each video frame, so that the finally displayed video data have stable display brightness. In this step, the following implementations are provided to determine the adjustment coefficient(s).

In some embodiments, a highest light transmittance H corresponding to the refresh rate F is calculated according to the refresh rate F and a formula $$H = \frac{\overline{H}}{\frac{1}{F} - \frac{tr}{2}},$$

and a ratio of the highest light transmittance H to a highest light transmittance $H_0$ corresponding to a default refresh rate is taken as the adjustment coefficient K. $\overline{H}$ is an average light transmittance corresponding to the default refresh rate, and tr is response time of the display panel.

A derivation process of the formula $$H = \frac{\overline{H}}{\frac{1}{F} - \frac{tr}{2}}$$

is similar to a derivation process of the embodiment shown in FIG. 7, which will not be repeated here.

In some embodiments, the adjustment coefficient is determined according to the refresh rate and a preset correspondence relationship between refresh rates and adjustment coefficients.

In this implementation, the adjustment coefficients under different refresh rates need to be acquired in advance through test data. In some embodiments, when displayed content remains unchanged, for example, when displaying a pure white image, the refresh rate is continuously changed, and each time the refresh rate is changed, the pixel value of the video frame is adjusted proportionally, so that the display brightness of the display panel under the refresh rate is consistent with the display brightness under the default refresh rate; and then an adjusted proportion is used as the adjustment coefficient, and the adjustment coefficient corresponding to each different refresh rate is determined accordingly. In this embodiment, the correspondence relationship between the refresh rate and the adjustment coefficient is preset, the corresponding adjustment coefficient is determined in real time according to the refresh rate, errors caused by formula calculation are avoided, and the accuracy of display brightness adjustment is improved.

S203, pixel processing is performed on each frame of the video data corresponding to the refresh rate according to the adjustment coefficient. In some embodiments, a pixel value of each pixel in each frame of the video data corresponding to the refresh rate is multiplied by the adjustment coefficient to obtain the processed video data. For example, the adjustment coefficient is (Kr, Kg, Kb), a pixel value of a certain pixel is (200, 100, 200), and then the two are multiplied to get (200*Kr, 100*Kg, 200*Kb). Kr, Kg and Kb may be the same or different.

S204, the processed video data are output to the panel driving board, so as to cause the panel driving board to drive the display panel to display the video data. In the embodiment of the present application, the refresh rate corresponding to the to-be-displayed video data is acquired in real time, the adjustment coefficient is determined according to the refresh rate, then pixel processing is performed on the to-be-displayed video data according to the adjustment coefficient, the magnitude of the pixel value is increased or decreased, the adjustment of the display brightness is realized, and thus the display brightness of the video data finally displayed on the display panel is stable.

Figure 12:
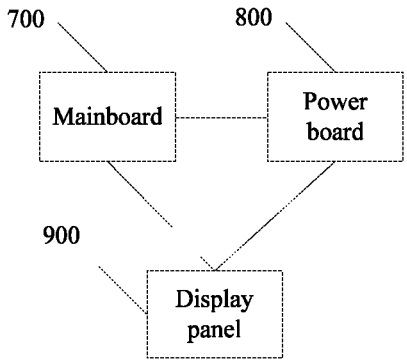
FIG. 12 is a schematic structural diagram of a display apparatus according to an embodiment of the present application.

In some embodiments, the present application realizes variable refresh rate by dynamically adjusting the backlight brightness and compensating or suppressing the display brightness of the display panel. FIG. 12 is a schematic structural diagram of a display apparatus according to an embodiment of the present application. As shown in FIG. 12, the display apparatus 004 includes a mainboard 700, a power board 800 and a display panel 900. The mainboard 700 is connected with the power board 800 and the display panel 900 respectively, the power board 800 is further connected with the display panel 900, and in some embodiments, the power board 800 is further connected with a backlight source of the display panel 900. The mainboard 700 is configured to acquire a refresh rate of to-be-displayed video data, generate a backlight control signal according to the refresh rate, and send the backlight control signal to the power board 800. The power board 800 drives the backlight source of the display panel 900 according to the received backlight control signal. Characteristics of backlight control signals corresponding to different refresh rates are different, including a duty cycle.

Figure 13:
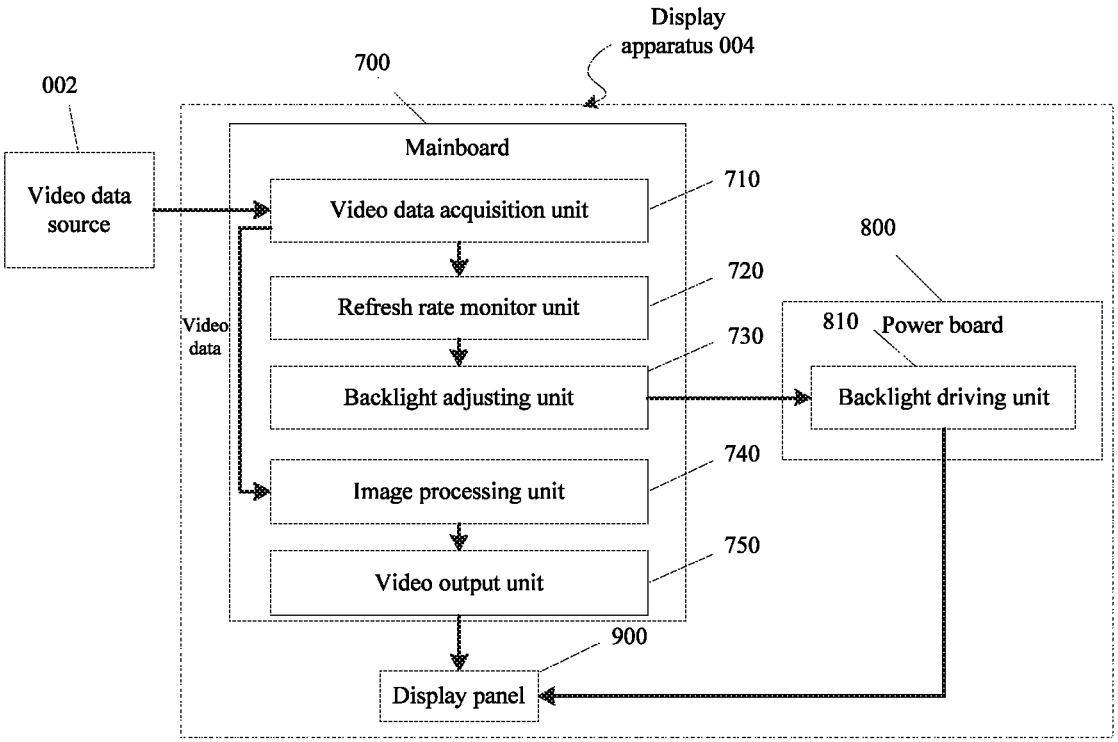
FIG. 13 is a schematic structural diagram of a display apparatus according to an embodiment of the present application.

FIG. 13 is a schematic structural diagram of a display apparatus according to an embodiment of the present application. As shown in FIG. 13, the mainboard 700 at least includes: a refresh rate monitor unit 720 and a backlight adjusting unit 730. The power board 800 includes: a backlight driving unit 810. In some embodiments, the mainboard 700 further includes a video data acquisition unit 710. The video data acquisition unit 710 is configured to acquire the to-be-displayed video data from a video data source 002, and perform decoding processing on the video data. In the embodiment of the present application, the video data source 002, the video data acquisition unit 710 and the refresh rate monitor unit 720 are consistent with the corresponding contents in the above embodiments, which will not be repeated here. The refresh rate monitor unit 720 sends the acquired refresh rate to the backlight adjusting unit 730, the backlight adjusting unit 730 determines the backlight brightness in real time according to the refresh rate, adjusts a backlight control signal and sends the backlight control signal to the backlight driving unit 810. In some embodiments, the backlight control signal may be a signal conforming to any transmission protocol, such as a pulse width modulation (PWM) signal, an $I^2C$ signal, a serial peripheral interface (SPI) signal, etc.

In some embodiments, different refresh rates correspond to different backlight brightness, and in order to realize the required backlight brightness, the backlight adjusting unit 730 needs to adjust the duty cycle of the backlight control signal. It should be understood that the higher the duty cycle of the backlight control signal, the longer the time for driving the backlight source to be lit, and the higher the backlight brightness perceived by human eyes; and vice versa, the lower the duty cycle of the backlight control signal, the lower the backlight brightness.

Figure 14:
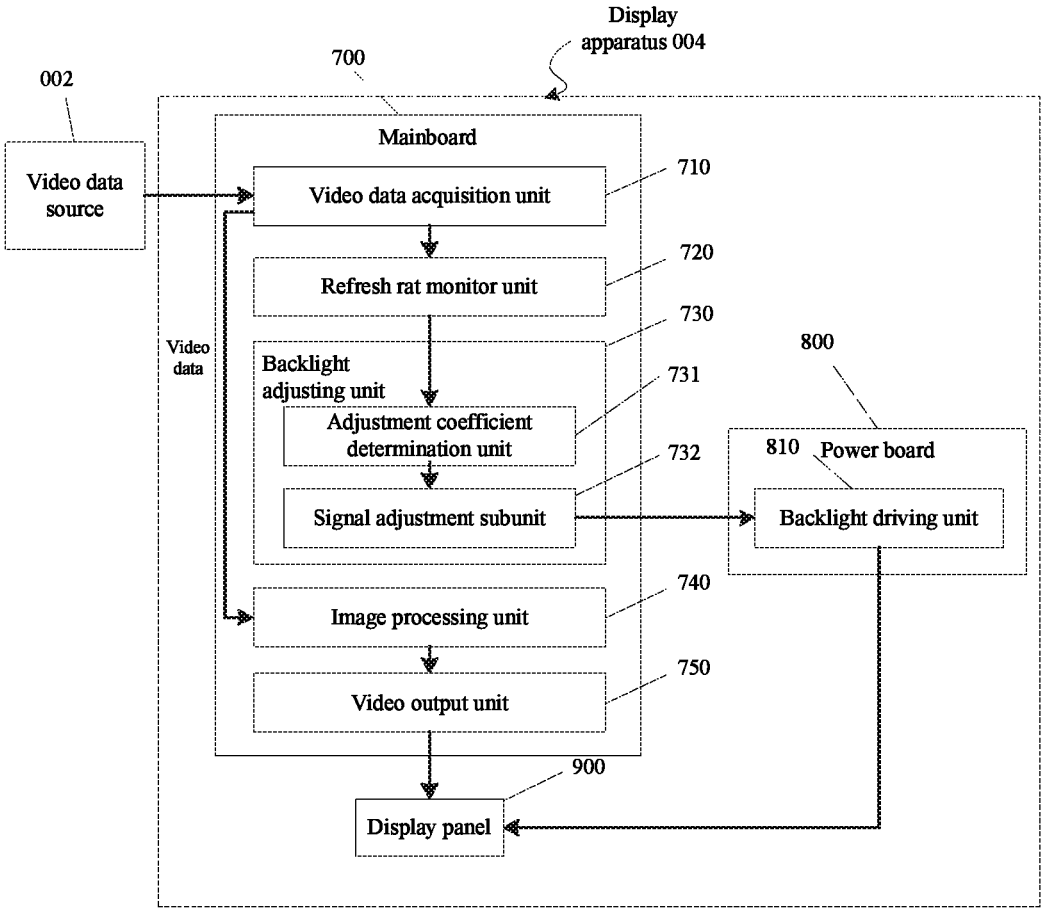
FIG. 14 is a schematic structural diagram of a display apparatus according to an embodiment of the present application.

FIG. 14 is a schematic structural diagram of a display apparatus according to an embodiment of the present application. As shown in FIG. 14, in some embodiments, the backlight adjusting unit 730 includes: an adjustment coefficient determination subunit 731 and a signal adjustment subunit 732. The adjustment coefficient determination subunit 731 determines an adjustment coefficient according to the refresh rate; and the signal adjusting subunit 732 obtains an adjusted duty cycle by adjusting a duty cycle of a default backlight control signal according to the adjustment coefficient, and generates the backlight control signal corresponding to the refresh rate according to the adjusted duty cycle. The default backlight control signal is a control signal preset for a default refresh rate. The backlight driving unit 810 drives backlight of the display panel to realize the required backlight brightness according to the backlight control signal, so as to compensate the dark display brightness when the refresh rate is high, or suppress the bright display brightness when the refresh rate is low.

In some embodiments, the mainboard 700 further includes: an image processing unit 740 and a video output unit 750. The image processing unit 740 acquires the video data from the video data acquisition unit 710, performs rendering processing on the video data, for example, performs optimizing processing on image quality of the video data, and then sends the processed video data to the video output unit 750. The video output unit 750 sends the video data to the display panel for display. In some embodiments, the video output unit 750 sends the video data to a panel driving board (not shown in the figure) through display signals, and the panel driving board generates and sends panel driving signals to the display panel 900, so as to cause the display panel 900 to display the corresponding video data.

In the display apparatus 004 according to the embodiment of the present application, the refresh rate of the to-be-displayed video data is acquired by the refresh rate monitor unit 720 in real time, the backlight control signal is adjusted by the backlight adjusting unit 730 according to the refresh rate, and then the backlight of the display panel is driven to realize the required backlight brightness by the backlight driving unit 810 according to the backlight control signal. The display brightness of the display panel is compensated or suppressed by adjusting the backlight brightness, so that the display brightness of the display panel remains stable.

Figure 15:
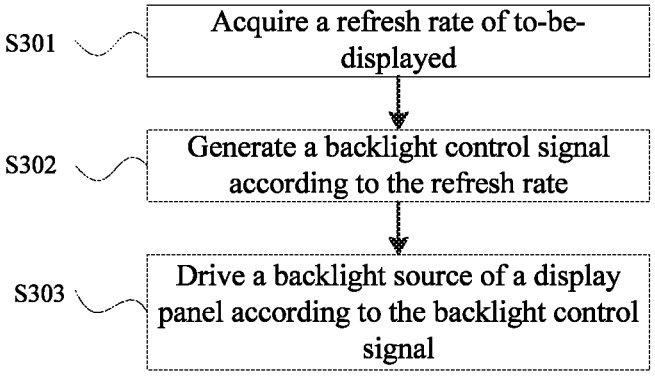
FIG. 15 is a schematic flow chart of a display control method according to an embodiment of the present application.

FIG. 15 is a schematic flow chart of a display control method according to an embodiment of the present application. As shown in FIG. 15, the method includes:

S301, a refresh rate of to-be-displayed video data is acquired.

S302, a backlight control signal is generated according to the refresh rate.

In this step, in order to adapt changes of the backlight brightness with changes of the refresh rate, the backlight control signal corresponding to the refresh rate is generated by a backlight adjusting unit 730 in real time according to the refresh rate. It should be understood that the backlight control signal has a duty cycle corresponding to the refresh rate. In some embodiments, an adjustment coefficient is determined according to the refresh rate, and a duty cycle of a default backlight control signal is adjusted according to the adjustment coefficient to obtain the backlight control signal corresponding to the refresh rate. The default backlight control signal is a control signal preset for a default refresh rate.

The embodiment of the present application provides the following implementations for how to determine and adjust the adjustment coefficient according to the refresh rate.

In some embodiments, the adjustment coefficient K is calculated according to the refresh rate F and a formula $$K = A\frac{\overline{H}}{\frac{1}{F} - \frac{tr}{2}};$$

where $\overline{H}$ is an average light transmittance corresponding to the default refresh rate, tr is response time of the display panel, and A is a preset coefficient. In some embodiments, A is generally a value larger than 0 and less than 2.

It should be understood that the highest light transmittance H is directly proportional to the backlight brightness to be adjusted, so the formula $$K = A\frac{\overline{H}}{\frac{1}{F} - \frac{tr}{2}}$$

may be derived from the formula $$H = \frac{\overline{H}}{\frac{1}{F} - \frac{tr}{2}}.$$

A derivation process of the formula $$H = \frac{\overline{H}}{\frac{1}{F} - \frac{tr}{2}}$$

is similar to the derivation process shown in FIG. 7, which will not be repeated here.

In some embodiments, the adjustment coefficient is determined according to the refresh rate and a preset correspondence relationship between the refresh rate and the adjustment coefficient.

In some embodiments, the adjustment coefficients under different refresh rates need to be acquired in advance through test data. In some embodiments, when displayed content remains unchanged, for example, when displaying a pure white image or other gray images, the refresh rate is continuously changed, and each time the refresh rate is changed, the duty cycle of the backlight driving signal is adjusted, so that the display brightness of the display panel under the refresh rate is consistent with the display brightness under the default refresh rate; and then a ratio between the duty cycle of the adjusted backlight control signal and the duty cycle of the backlight control signal under the default refresh rate is used as the adjustment coefficient corresponding to the refresh rate.

In some embodiments, the adjustment coefficient corresponding to the refresh rate acquired in real time is multiplied by the duty cycle of the default backlight control signal, so as to obtain the duty cycle of the backlight control signal corresponding to the refresh rate, the duty cycle of the default backlight control signal is adjusted to the duty cycle of the required backlight control signal, and then the backlight driving signal is output to the backlight driving unit 810.

The following embodiment will take PWM signal as an example of backlight control signal. For a certain video frame, assuming that the duty cycle of the PWM signal is PWM1=15% at the default refresh rate of 60 Hz, it is known by comparing the correspondence relationship between the refresh rate and the backlight control signal that when the refresh rate is 120 Hz, the adjustment coefficient K=2. Then the duty cycle of the PWM signal should be set as PWM2*K=30%.

S303, a backlight source of the display panel is driven according to the backlight control signal.

In the embodiment of the present application, the refresh rate corresponding to the to-be-displayed video data is acquired in real time, the backlight control signal is generated according to the refresh rate, then the backlight source of the display panel is driven to realize the required backlight brightness according to the backlight control signal, by adjusting the backlight brightness, the display brightness of the display panel is compensated or suppressed, and thus the display brightness of the display panel remains stable.

The above embodiments have been described to better explain the principles and practical applications, so as to enable those skilled in the art to better utilize the embodiments and various modified embodiments suitable for specific use considerations.

What is claimed is:

1. A display apparatus, comprising:

a mainboard;

a power board, in connection with the mainboard; and a display panel, in connection with the mainboard and the power board; wherein the mainboard is configured to:

acquire a refresh rate of to-be-displayed video data; and generate a backlight control signal according to the refresh rate of the to-be-displayed video data, wherein a first duty cycle of a first backlight control signal corresponding to a first refresh rate is different from a second duty cycle of a second backlight control signal corresponding to a second refresh rate, and the second refresh rate is different from the first refresh rate; and the power board is configured to:

receive the backlight control signal; and drive a backlight source of the display panel according to the backlight control signal;

wherein the mainboard comprises:

a refresh rate monitor unit, configured to acquire the refresh rate of the to-be-displayed video data; and a backlight adjusting unit, configured to generate the backlight control signal according to the refresh rate acquired by the refresh rate monitor unit;

wherein the backlight adjusting unit is further configured to:

determine an adjustment coefficient according to the refresh rate of the to-be-displayed video data; and obtain an adjusted duty cycle for the refresh rate by adjusting a duty cycle of a default backlight control signal according to the adjustment coefficient, and generate the backlight control signal corresponding to the refresh rate according to the adjusted duty cycle, wherein the default backlight control signal is preset for a default refresh rate;

wherein the backlight adjusting, unit is further configured to:

calculate the adjustment coefficient K according to the refresh rate F and a formula $$K = A\frac{\overline{H}}{\frac{1}{F} - \frac{tr}{2}};$$

wherein $\overline{H}$ is an average light transmittance of the display panel corresponding to the default refresh rate, tr is response time of the display panel, and A is a preset coefficient.

2. The display apparatus according to claim 1, wherein the refresh rate monitor unit is configured to: determine the refresh rate according to a vertical synchronization signal corresponding to a video frame in the to-be-displayed video data.

3. The display apparatus according to claim 1, wherein A is a value greater than 0 and less than 2.

4. The display apparatus according to claim 1, wherein the backlight adjusting unit is further configured to:

obtain the adjusted duty cycle for the refresh rate by multiplying the duty cycle of the default backlight control signal with the adjustment coefficient.

5. The display apparatus according to claim 1, wherein the backlight control signal comprises PWM signal.

6. A display control method for a display apparatus, comprising:

acquiring a refresh rate of to-be-displayed video data on a display panel of the display apparatus; and generating a backlight control signal for the display panel according to the refresh rate of the to-be-displayed video data;

wherein a first duty cycle of a first backlight control signal corresponding to a first refresh rate is different from a second duty cycle of a second backlight control signal corresponding to a second refresh rate, and the second refresh rate is different from the first refresh rate;

drive a backlight source of the display panel according to the backlight control signal, wherein the generating the backlight control signal according to the refresh rate of the to-be-displayed video data, comprises:

determining an adjustment coefficient according to the refresh rate of the to-be-displayed video data;

obtaining an adjusted duty cycle for the refresh rate by adjusting a duty cycle of a default backlight control signal according to the adjustment coefficient; and generating the backlight control signal corresponding to the refresh rate according to the adjusted duty cycle;

wherein the default backlight control signal is preset for a default refresh rate;

wherein the determining the adjustment coefficient according to the refresh rate of the to-be-displayed video data, comprises:

calculating the adjustment coefficient K according to the refresh rate F and a formula $$K = A\frac{\overline{H}}{\frac{1}{F} - \frac{tr}{2}};$$

wherein $\overline{H}$ is an average light transmittance of the display panel corresponding to the default refresh rate, tr is response time of the display panel, and A is a preset coefficient.

7. The method according to claim 6, wherein the method further comprises: determining the refresh rate according to a vertical synchronization signal corresponding to a video frame in the to-be-displayed video data.

8. The method according to claim 6, wherein A is a value greater than 0 and less than 2.

9. The method according to claim 6, wherein the obtaining the adjusted duty cycle for the refresh rate by adjusting the duty cycle of the default backlight control signal, comprises:

obtaining the adjusted duty cycle for the fresh rate by multiplying the duty cycle of the default backlight control signal with the adjustment coefficient.

10. The method according to claim 6, wherein the backlight control signal comprises PWM signal.

* * * * *